US006575109B1

(12) United States Patent
Gongwer

(10) Patent No.: US 6,575,109 B1
(45) Date of Patent: Jun. 10, 2003

(54) THRUSTER SCREEN

(75) Inventor: Calvin A. Gongwer, Glendora, CA (US)

(73) Assignee: Innerspace Corporation, Covina, CA (US)

( * ) Notice: Subject to any disclaimer, the term of this patent is extended or adjusted under 35 U.S.C. 154(b) by 0 days.

(21) Appl. No.: 10/061,592

(22) Filed: Feb. 1, 2002

(51) Int. Cl.[7] ..... B63H 25/46; B63H 11/01

(52) U.S. Cl. ..... 114/151; 440/46; 440/47; 440/67

(58) Field of Search ..... 114/151; 440/67, 440/72, 47, 46, 18, 17; 60/221, 222; 454/358

(56) References Cited

U.S. PATENT DOCUMENTS 2,903,850 A * 9/1959 Lang ..... 60/221
3,044,259 A * 7/1962 Tuttle ..... 415/124.1
3,464,357 A * 9/1969 Duport et al. ..... 114/151
3,593,686 A * 7/1971 Cooper et al. ..... 114/151
4,315,476 A * 2/1982 van der Tak ..... 114/151
4,423,696 A * 1/1984 Aker ..... 114/148
4,565,530 A * 1/1986 Espenhain ..... 440/13
5,915,324 A * 6/1999 Gongwer ..... 114/151
6,152,793 A * 11/2000 Gongwer ..... 114/151

FOREIGN PATENT DOCUMENTS

FR 80.094 * 12/1963 ..... 440/46

* cited by examiner

*Primary Examiner*—Sherman Basinger
(74) *Attorney, Agent, or Firm*—White & Case LLP

(57) ABSTRACT

A screen system for marine thrusters having at least one constrictor for reducing exit jet cross-sectional area to increase exit jet velocity of a thruster.

5 Claims, 9 Drawing Sheets

THRUSTER SCREEN

FIELD OF THE INVENTION

The field of the invention pertains to thruster systems, including more particularly, screens for marine thrusters.

BACKGROUND

Marine vehicles, from large ships to umbilically controlled underwater robots (ROV's) and small submarines, typically use ducted propeller thrusters to control their position and attitude and, except for large ships and some submarines, to provide main propulsion. These thrusters can experience problems not limited to thrust-limiting cavitation at and near the surface, interruption of operations from ingestion of foreign objects, creating hazards to marine life and divers, and excessive screen resistance to flow. These problems were addressed by a screen system described in the U.S. Pat. No. 6,152,793, titled SCREEN SYSTEM FOR MARINE THRUSTERS, which is incorporated fully herein by reference. However, the forward speed of a vehicle is still limited by the exit jet velocity of the thruster. A higher exit jet velocity would increase the thrust with the forward speed of a vehicle. Therefore, there is a need for a screen system that reduces thrust-limiting cavitation, while increasing the exit jet velocity of a thruster.

SUMMARY OF THE INVENTION

The present invention comprises screen having at least one opening and one constrictor associated with at least one opening. The constrictor changes the exit jet cross-sectional area to increase exit jet velocity, enhancing the overall thruster performance of propulsion devices.

The screens may be placed around propulsion devices in land vehicles, sky vehicles, and marine vehicles, such as those for ROV's and small submarines, to assist positioning, attitude and overall propulsion. The screens, when made in larger dimensional scales, can be applied to large ship transverse thrusters at each end of the tunnel with the same advantages.

DETAILED DESCRIPTION OF THE PREFERRED EMBODIMENT

Figure 1A:
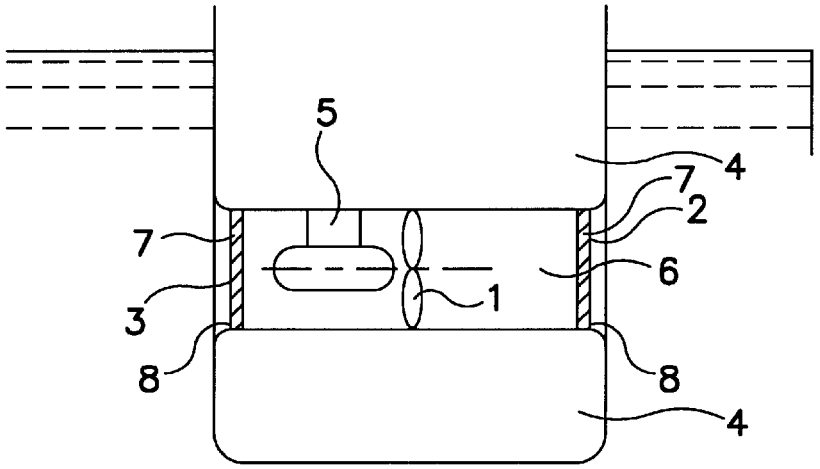
FIG. 1A is a cross-sectional view of a bi-directional thruster screen system.
Figure 1B:
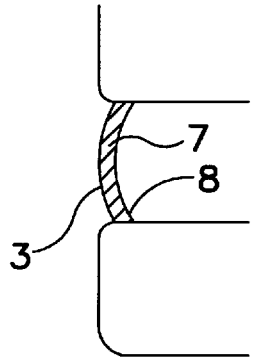
FIG. 1B is a cross-sectional view of a screen system that has curved profile.

Referring to FIG. 1A, a representative cross-section of a bi-directional thruster screen system of the present invention is shown. A thruster is mounted in a duct 6 enclosing a reversible propeller 1 with a pair of contoured streamlined screen elements: a front screen 2 and a rear screen 3, in the housing, or vehicle 4. The use of the terms "front" and "rear" are relative terms merely used to facilitate the description of the invention and is by no way intended to limit the scope of the invention. In one operational configuration, flow into duct 6 enters via front screen 2, passes by propeller 1 and exits duct 6 via the rear screen 3. In reverse operation of propeller 1, flow enters the duct system via rear screen 3, passes by propeller 1 and exits the duct system via front screen 2. Because propeller 1 may be reversible, either operational configuration is possible. Although screens 2 and 3 are depicted as planar in FIG. 1A, they are not so limited. The cross sections of screens 2 and 3 can be of any shape, such as the curved profile as shown in FIG. 1B. As shown in FIG. 1A, both screens 2 and 3 have openings 7 and constrictors 8. The constrictors 8 are shown to be installed at the perimeter of screens 2 and 3; however, they are not so limited, and could be installed anywhere at screens 2 and 3.

Figure 2:
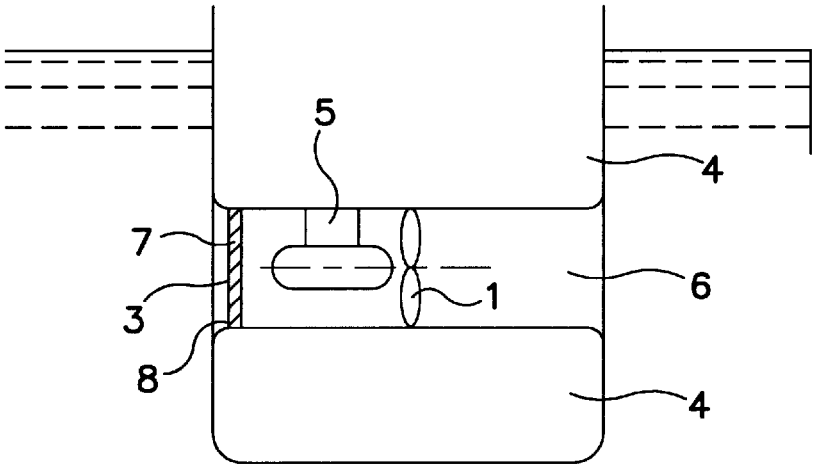
FIG. 2 is a cross-sectional view of a single directional thruster screen system.

FIG. 2 illustrates a representative cross-section of a thruster screen duct system of the present invention for a single directional thruster system. Note that only one screen is necessary for a single directional thruster system.

Figure 3:
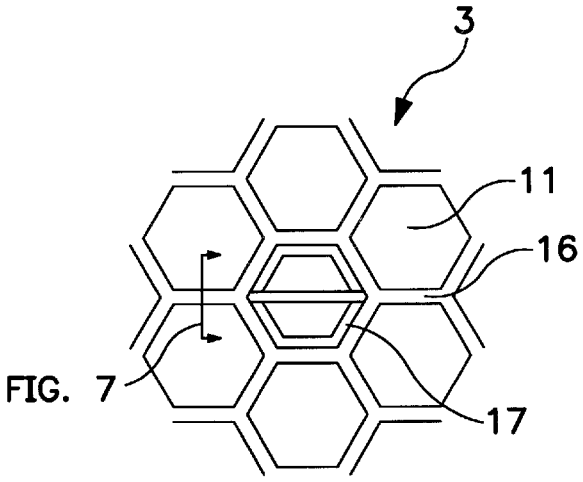
FIG. 3 is a front view of a screen grating having hexagonal openings.
Figure 4:
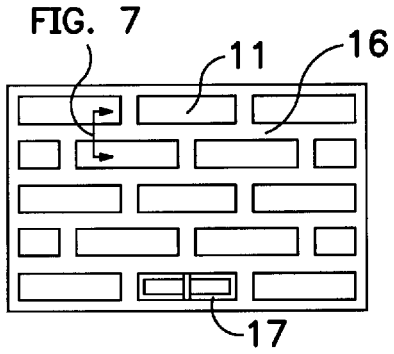
FIG. 4 is a front view of a screen grating having rectangular openings.
Figure 5:
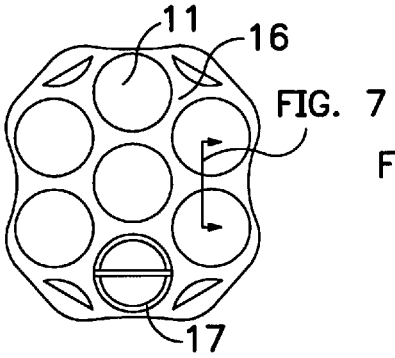
FIG. 5 is a front view of a screen grating having curved openings.
Figure 6:
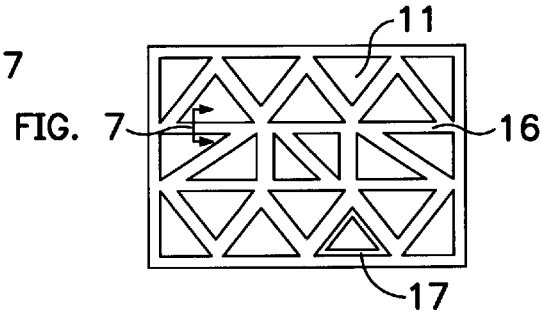
FIG. 6 is a front view of a screen grating having triangular openings.

FIG. 3 illustrates a preferred embodiment of the present invention. FIG. 3 shows a portion of the front view of screen 3, such as that shown in FIGS. 1A to 2. Screen 3 is constructed with the apertures 11 forming the basic building block of the screen. This shape is preferable as the basic building block for the screen due to the large angle (120 degrees) between intersecting legs of the gratings 16 enclosing the apertures 11. This angle reduces the hydrodynamic interference between the geometric hexagons formed by apertures 11. A screen with square, triangular, circular, or other geometrically shaped openings may be preferable in some cases. FIGS. 4, 5, and 6 illustrate screens with rectangular, curved, and triangular openings, respectively. A constrictor 17, such as those shown in FIGS. 1A to 2, is installed at an opening of the screens shown in FIGS. 3 to 6. Although only several examples of the shape of the openings are shown, the shape of the openings can be of any shape without departing from the advantage of the present invention.

Figure 7:
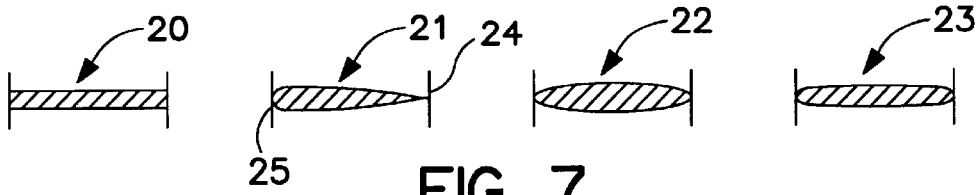
FIG. 7 is variations of cross-sectional views of a screen grating.

The cross-section of the grating of the screens in FIGS. 3 to 6 is shown in FIG. 7. In FIG. 7, the cross-section 20 of the grating is shown to be uniform. On the other hand, cross-section 21 is shown to have a tapered end 24 and a contoured end 25. The cross-section 21 of the screen grating is preferable because it could reduce cavitation or eddies caused by the flow of fluids. However, to reduce cavitation or eddies caused by the flow of fluids, in some applications it may be more beneficial to have a cross-sectional area wherein both ends are tapered (cross section 22) or wherein both ends are contoured (cross section 23). Although only several examples of the cross-sections are shown, the cross-section of the grating can be of any shape without departing from the advantage of the present invention.

Figure 8:
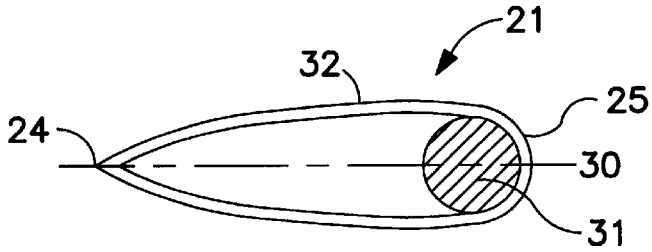
FIG. 8 is a cross-sectional view of a screen grating.
Figure 14C:
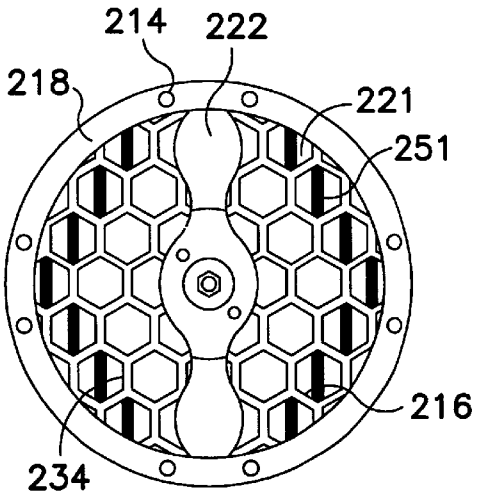
FIGS. 14B–14C are end views of a free-standing compact screened thruster system.
Figure 14A:
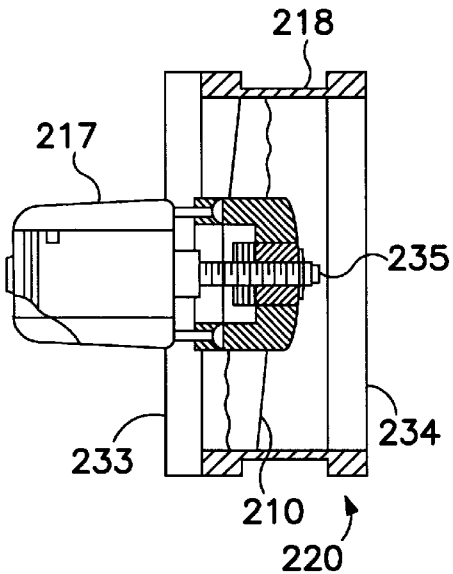
FIG. 14A is a side view of a free-standing compact screened thruster system.

As shown in FIG. 8, the screen gratings having cross-section 21 are preferably constructed from hard-anodized aluminum and be formed by wrapping sheet metal 32 or other appropriate material around a bar screen element 31. The presently most preferable construction of the screens when employed as part of a free-standing thruster system, such as that shown in FIG. 14A, is from cast hard-anodized aluminum.

Figure 9A:
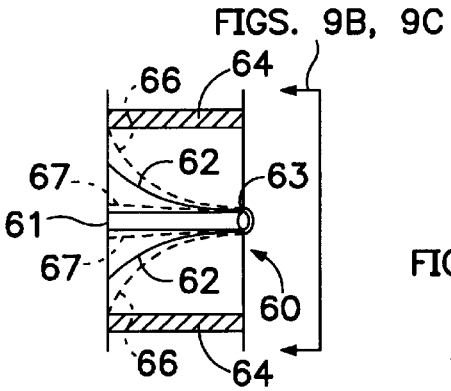
FIG. 9A is a side view of a reed type constrictor.
Figure 9B:
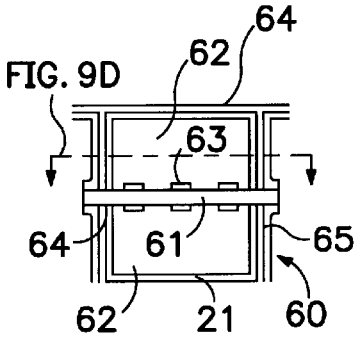
FIGS. 9B–9C are front views of variations of a reed type constrictor.
Figure 9C:
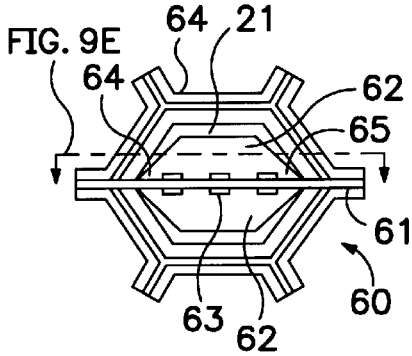
Figure 9D:
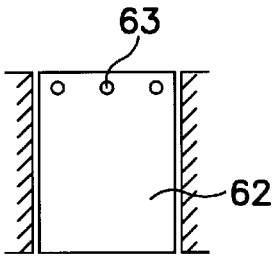
FIGS. 9D–9E are top views of variations of a reed type constrictor.
Figure 9E:
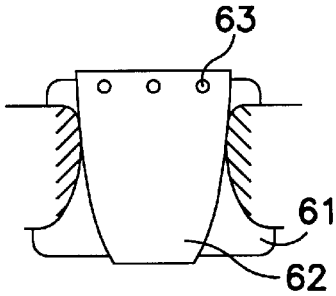

FIG. 9A shows a preferred embodiment of the constrictor 60 such as those shown in FIGS. 3 to 6. The constrictor 60 is of reed type and it comprises a center plate 61 and opening covers 62. FIGS. 9B and 9C shows front views of a constrictor 60 installed in a screen cell 21 having rectangular and hexagonal shaped openings, respectively. Although only two shapes of opening are shown in FIGS. 9B and 9C, other shapes of opening are possible. As shown in FIGS. 9B and 9C, center plate 61 is secured, preferably, to the opposite sides or corners 64 and 65 of the geometric screen cell 21. In a preferred embodiment, on each side of the center plate 61, an opening cover 62 is mounted in such a way so as to allow the constrictor 60 to automatically open or close when the screen cell is part of the outlet or inlet, respectively. As shown in FIGS. 9A–9E, the opening covers 62 are preferably attached to center plate 61 by bolts 63. However, other methods of attachment, such as welding, could be used as well. The opening covers 62 could be of reed type, and the reed material could be stainless steel sheet or other materials of a thickness to allow the opening covers 62 to bend in flexure as indicated in FIG. 9A. In FIG. 9A, dashed lines 66 and 67 illustrate the position of the opening covers 62 when the constrictor 60 is closed and opened, respectively.

Figure 10A:
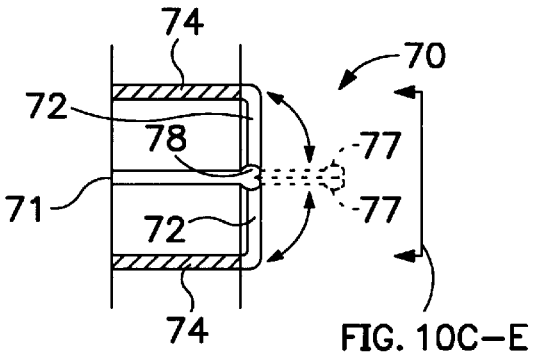
FIGS. 10A–10B are side views of variations of constrictor.

FIG. 10A illustrates a variation of the constrictor. The constrictor 70 shown in FIG. 10A comprises a center plate 71 and opening covers 72. The center plate 71 is secured preferably near the center of the opening as defined by edges 74 of the opening of the grating. The opening covers 72 are connected to the end of the center plate 71 by hinges 78. As such, the opening covers 72 could assume a closed position as shown in FIG. 10A, or an opened position as illustrated by dashed lines 77.

Figure 10B:
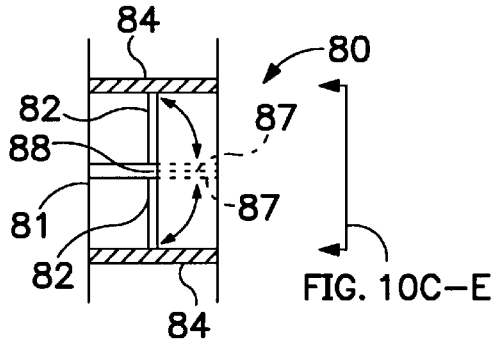

FIG. 10B illustrates another variation of the constrictor. The constrictor 80 shown in FIG. 10B comprises a center plate 81 and opening covers 82. The center plate 81 does not extend the full depth of the grating and is secured preferably near the center of the opening as defined by edges 84 of the opening of the grating. The opening covers 82 are connected to the end of the center plate 81 by hinges 82. As such, the opening covers 82 could assume a closed position as shown in FIG. 10B, or an opened position as illustrated by dashed lines 87. Because the center plate 81 does not extend through the depth of the grating, the opening covers fit within the depth of the grating when they assume the closed position as illustrated by dashed lines 87. This variation of the constrictor is preferred over that shown in FIG. 10A because it is more space-efficient.

Figure 10C:
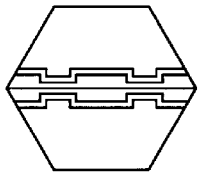
FIGS. 10C–10E are front views of variations of opening covers.
Figure 10D:
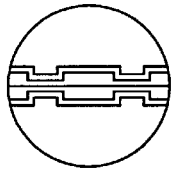
Figure 10E:
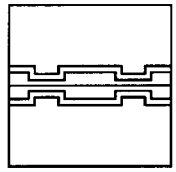

FIGS. 10C to 10E illustrate several different shapes of opening cover that can be used with the types of constrictor shown in FIG. 10A or 10B. The opening covers are shaped in accordance with the shape of the openings. As such, the types of constrictor shown in FIGS. 10A and 10B has the advantage that they could be employed with virtually any shape of opening.

Figure 11A:
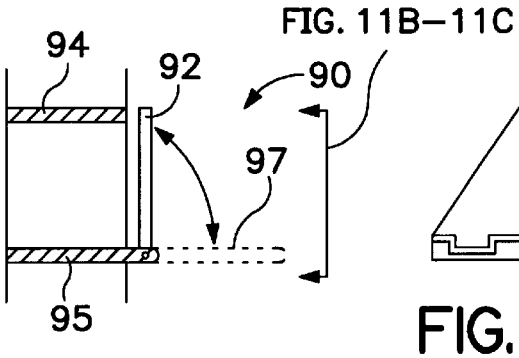
FIG. 11A is side view of variation of constrictor.
Figure 11B:
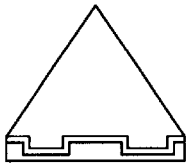
FIGS. 11B–11C are front view of variation of opening covers.
Figure 11C:
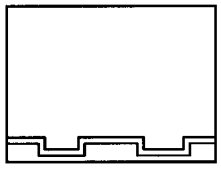

FIG. 11A illustrates yet another variation of the constrictor. The constrictor 90 comprises only an opening cover 92 that is connected to the end of edge 95 of an opening. In this variation, there is no need for a center plate. The opening cover 92 could assume a closed position as shown in FIG. 11A or an opened position as illustrated by dashed line 97. FIGS. 11B and 11C illustrate two shapes of opening cover that can be used with the type of constrictor shown in FIG. 11A. However, other different shapes of opening cover are possible. Furthermore, in an alternative embodiment similar to that shown in FIG. 10B, the edge 95 extends partially into the depth of the grating so that the opening cover 92 fits within the depth of the grating when it assumes an opened position.

It should be noted that although several types of constrictors of the screen system are discussed, they are not so limited. The constrictors of the screen system could be of any type that is capable of opening and closing the apertures of the screen cells. Furthermore, the constrictors of the screen system could also be mechanically or electrically controlled, not subject to the flow characteristic through the screen. However, the constrictors as shown in FIGS. 9A, 10A, 10B, and 11A are preferred because they can be controlled automatically by the flow direction through the thruster system, as will be discussed in more detail below.

Figure 12A:
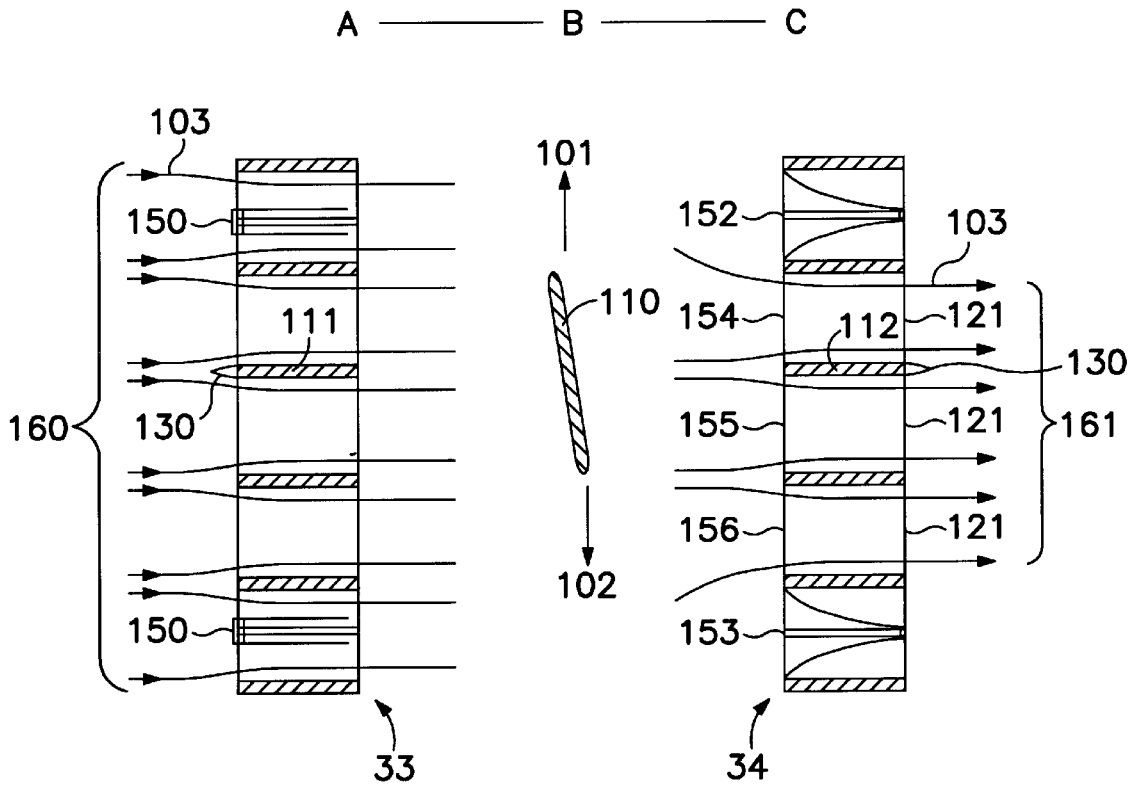
FIG. 12A is a cross-sectional view of a planar screen system having constrictors.

By examining the effects imparted on the flow by the various elements in the screen thruster system, the performance enhancements characterizing the present invention can be best described. FIG. 12A depicts a cross-sectional view of a bi-directional screen system that has constrictors, such as the one shown in FIGS. 9A through 11C. The cross-sections of the gratings of screens 33 and 34 are shown as contours 111 and 112, respectively. The contours 111 and 112 are preferably congruent, permitting the screens to be reversible. As shown, constrictors 150 and 151 are installed at the perimeter of screen 33, and constrictors 152 and 153 are installed at the perimeter of screen 34. Because the thruster screen system can be bi-directional, flow can be in either direction, depending which way the propeller 110 is turning, as illustrated by arrows 101 and 102. As discussed above, the cross-sectional shape of the gratings is not limited to that shown in FIG. 12A. The choice of contoured or tapered ends can be selected to minimize the formation of eddies 130. The incoming flow to the propeller 110, or other marine device, is only slightly restricted if the screen parts are streamlined in the flow direction.

Because the thruster screen system can be bi-directional, flow can be directed from A-B-C or C-B-A in FIG. 12A, depending which direction 101 or 102 the propeller 110 is turning. When the flow is in the direction indicated by the arrow 103, screens 33 and 34 become the inlet and the outlet, respectively. In the flow direction indicated by arrow 103, the inflow through the constrictors 150 and 151 of screen 33 causes the constrictors to open as shown in FIG. 10A, and as such, the cross sectional area 160 of the inlet jet is maximized. At the exit end of the thruster system, the exit flow through the constrictors 152 and 153 of screen 34 causes the constrictors to close as shown in FIG. 10A, reducing the cross sectional area 161 of the exit jet through screen 34. At the exit screen 34, the closed constrictors 152 and 153 cause the remaining open screen cells 154, 155, and 156 to act as a nozzle, further accelerating the flow of the exit jets, and increasing the pressure inside the duct and around the motor, propeller, umbilical cord and so forth. As the result, the overall thruster performance is enhanced.

Figure 12B:
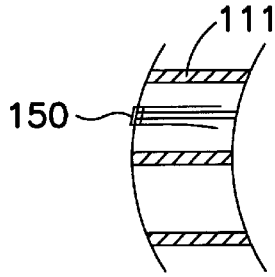
FIG. 12B is a cross-sectional view of a curved screen system having constrictors.

Although the screens 33 and 34 in FIG. 12A are shown to be planar in cross-section, as discussed previously, they are not so limited and could assume any profile. FIG. 12B depicts a cross-section of a screen system that has a curved profile.

Figure 13:
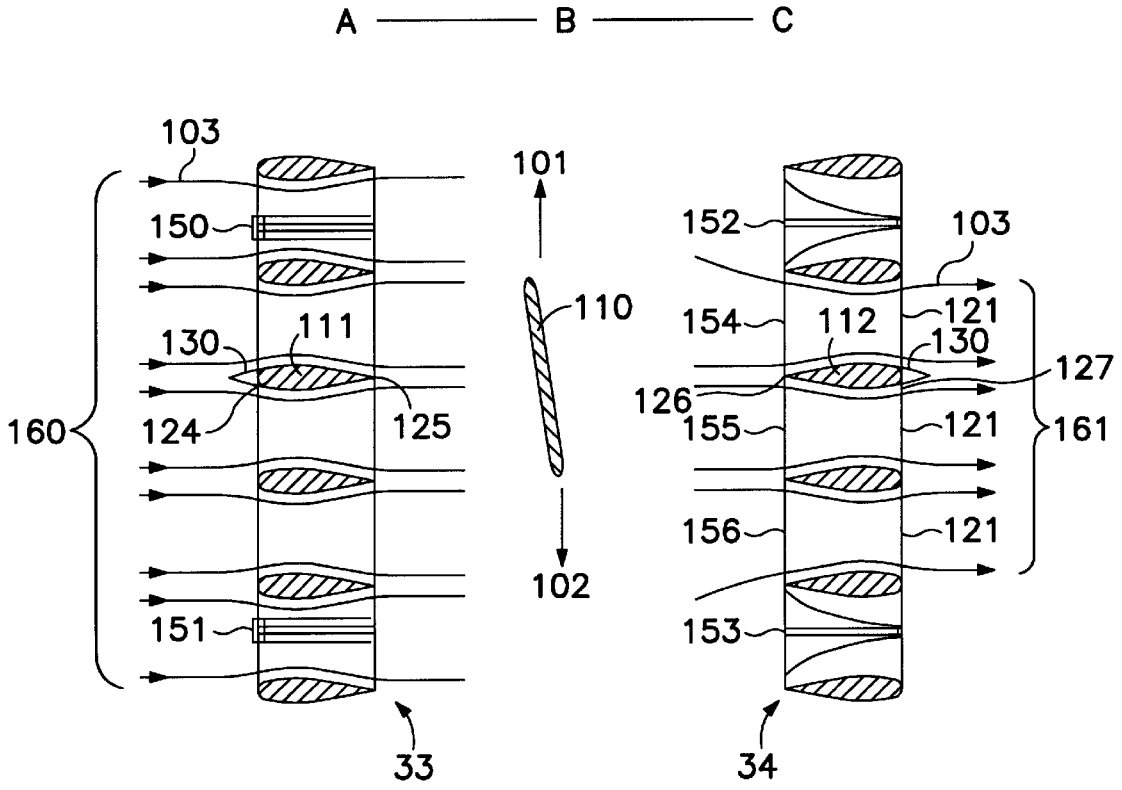
FIG. 13 is a cross-sectional view of a screen system having contoured gratings.

As explained above, the cross-section of the screen grating can be of any shape. FIG. 13 illustrates that the same bi-directional screen system shown in FIG. 12 can have cross-section of grating where one end is tapered and the other end is contoured. As FIG. 13 depicts, the tapered ends 125 and 126 preferably point towards the propeller 110 and the contoured ends 124 and 127 preferably are directed away from the propeller 110. Because the screens 33 and 34 are each attached such that the tapered ends of the screens face outward in either direction the fluid flowing into the propeller is subjected to the same flow characteristics and the fluid exiting the propeller are also subjected to the same flow characteristics. The contoured end 124 of screen 33 and the contoured end 127 of screen 34 formed into geometrically-shaped apertures and cause the apertures to act as a nozzle, accelerating the flow of the exit jets to a higher velocity. Eddies 130 formed at the contoured ends 124 and 127 are also indicated. The flow lines 103 caused by the contoured shape of screens 33 and 34 are streamlined for flow in one direction and unstreamlined for flow in the other direction and provide a hydrodynamic advantage to the overall thruster operation, tending to suppress loss of thrust from a propeller cavitation, or a housing device, and increase propeller efficiency in both directions, notwithstanding the screen's resistance to flow. The constrictors 150–153 further enhance the flow velocity through the screens by changing the cross-sectional area of the exit-inlet jet, as explained previously.

FIGS. 12 and 13 illustrate how the screen system works in a bi-directional thruster system. However, the screen system could also be employed in a single directional thruster system as shown in FIG. 2. In a single directional thruster system, only the exit screen 34 is needed. The constrictors in a single directional thruster system can be constructed in such a way so that the opening covers remain open when the exit jet has a low velocity and close when the exit jet velocity reaches a threshold level. For example, the opening covers 62 of the reed type constrictor shown in FIG. 9A can be constructed with more rigid or thicker material for a single directional system so that the covers 62 remain open when the exit jet has a low velocity, and bent further in flexure to completely close the opening when the exit jet has reached a threshold velocity. Other methods of adjusting the threshold velocity required for closing the constrictor are possible, such as the use of springs and hydraulics, and are not limited to the example discussed.

FIG. 14A shows a free-standing compact screened thruster system 220 of the present invention that can be mounted to the interior of a duct 6 without the need of the mounting bracket 5 shown in FIG. 1. Through the use of the unique rigid motor housing screen 233 and propeller screen 234, the motor housing may be mounted directly to the interior of duct 6 by housing 18, or may be used without a duct. Thus the free-standing thruster system of FIG. 14A is preferred for use on ROV's (remote operated vehicles) and the like.

Figure 14B:
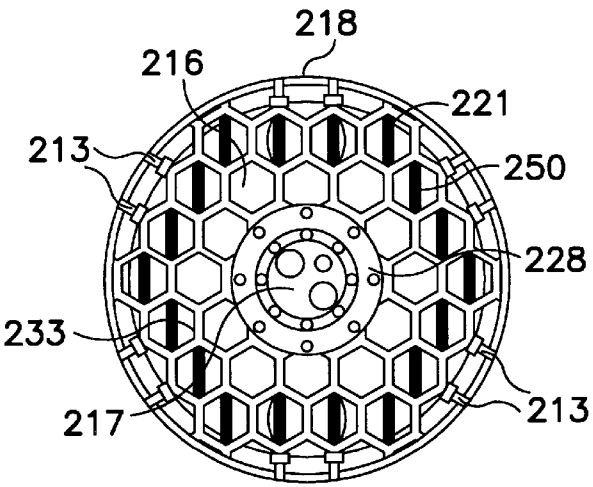

FIG. 14B is a motor end view of the screened thruster system 220. The motor housing screen 233 is attached to motor housing 217 by means of a motor mounting ring 228. This securely mounts the motor. The motor housing screen 233 is secured around its periphery to a housing 218 either by bolts 213 or if desired permanently attached by welding or the like. FIG. 14B shows the geometric shaped aperture grating 216 of motor housing screen 233 to be hexagonal. The motor housing screen 233 extends from the motor housing 217 to the end of the housing 218 so that no debris can reach the propeller 210. Hub 235 attaches the propeller 210 to the motor 217. The propeller 210 may be one of many typical reversible propeller configurations including, preferably, the orthoskew propeller described in U.S. Pat. No. 5,275,535 which is incorporated fully herein by reference. However, other straight-edged and contoured propellers would work with the screens. As seen in FIG. 14C, which has a portion of the screen 234 cut away, the unique shape of the blades 222 of the orthoskew propeller provides efficient bi-directional thrust. The propeller screen 234 is shown preferably attached to the housing 218 by bolts 214 spaced around the circumference of housing 218. While the exterior of the housing 218 is shown cylindrical it could be any geometric shape appropriate for the application. As shown in FIGS. 14B and 14C, constrictors 250 and 251 are installed at screen 233 and screen 234, respectively. The constrictors 250 and 251 are preferably in the periphery of the jet as shown in FIGS. 14B and 14C and occupying the screen cells 221 around the perimeter of the screens 233 and 234. The only differences between this free-standing screened thruster system and the screen systems described previously are that the screens are more compact and are spaced closer together. The description of the performance enhancement of the screen systems discussed previously applies similarly to this free-standing screened thruster system.

Figure 15:
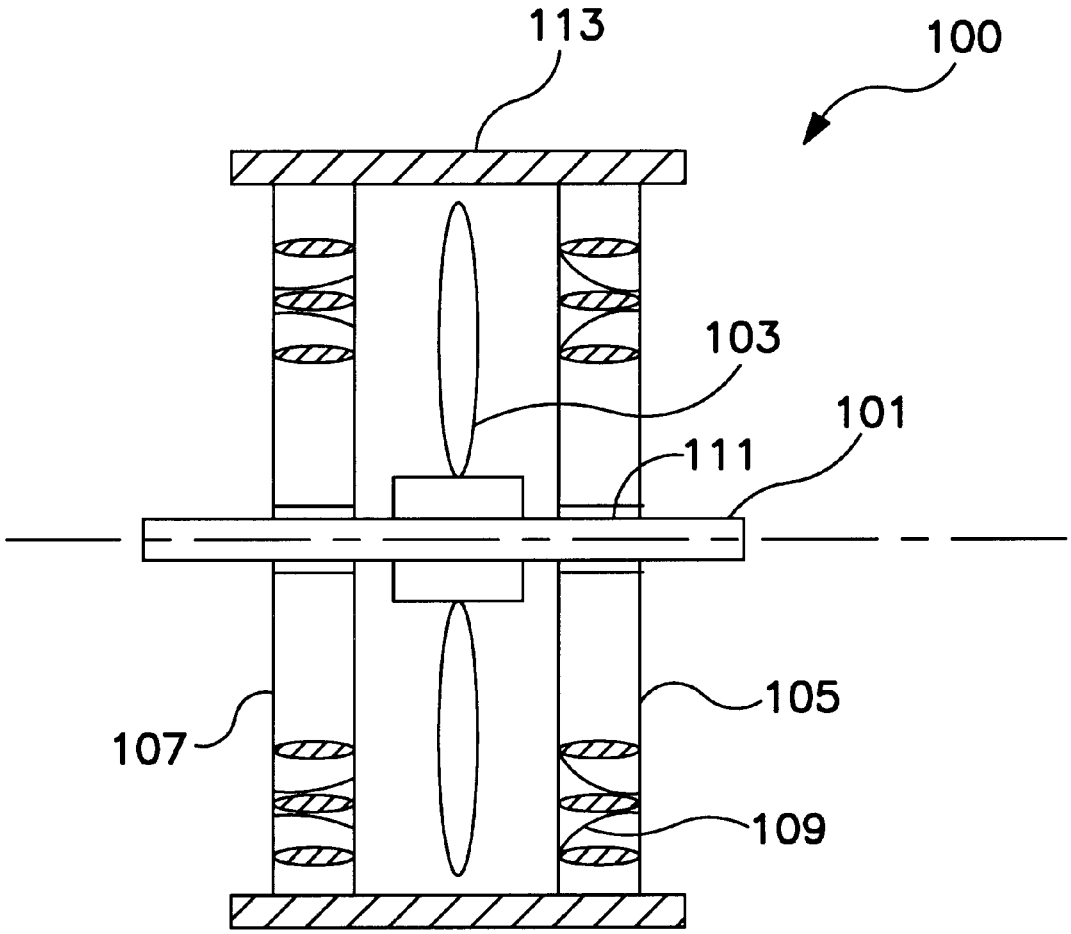
FIG. 15 is a side view of a thruster screen system with straddle mounting.

FIG. 15 is a side view of a thruster screen system 100 with straddle mounting. Screens 105 and 107, both having constrictors 109, are secured to a side 113 of a vehicle. Each of the screens 105 and 107 has an opening 111 near the center for supporting a shaft 101 of a propeller 103. As such, this configuration allows the propeller 103 to be straddle-mounted to the centers of the screens 105 and 107, and eliminates the need for using separate struts for mounting the propeller 103.

Figure 16:
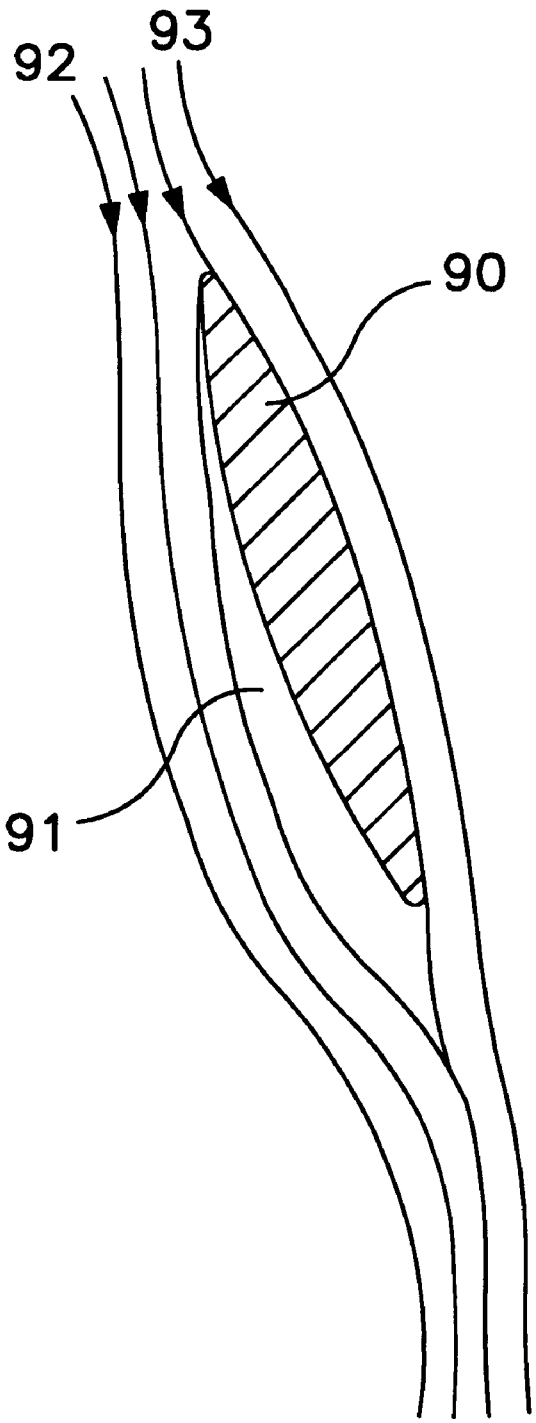
FIG. 16 is a side view of a propeller blade including representative flow lines.

The empirical equation representing the relationship between the thrust limit set by cavitation and the exit jet cross-sectional area can be derived as follow. Referring to FIG. 16, the slightly reduced flow rate thru the propeller 90 causes the pressure on the suction side 91 of the propeller blades to increase and thus suppress the cavitation. The physical picture at breakdown cavitation is shown in the FIG. 16 where the static pressure on the suction side 91 of the propeller blade 90 is essentially zero. The suction side 91 of propeller blade 90 is created by a vapor cavity where the absolute pressure is the vapor pressure of water, virtually zero for cold water. This can be expressed by the Equation (1) which gives the static pressure on the suction side of the propeller blades:

$$\underset{\text{33 ft}}{\text{Atmospheric pressure}} + \underset{d}{\text{depth in ft}} - (V_p^2)/(2gS) = 0 \quad (1)$$

where $V_p$ is the axial velocity thru the propeller disc and S is the solidity the propeller (the projected blade area as a fraction of the swept disc area). Equation (1) is obtained by applying Bernoulli's theorem to the flow through the thruster inlet from the ambient sea. The slight drop in head thru the inlet screen need not be considered since the screen is streamlined in this direction. $V_p$ is related to the exit velocity out the exit screen by the following:

$$V_p = (V_e A_e)/(A_p) \text{ from continuity,} \quad (2)$$

where $A_e$ and $A_p$ are the flow cross section areas at the exit and propeller disc respectively.

Substituting from (2) into (1):

$$33' + d' - \frac{(V_e^2 A_e^2)}{2gS(A_p^2)} = 0 \quad (3)$$

Since the static thrust T is given by the expression:

$$T = \rho V_e^2 A_e \quad (4)$$

where ρ is the mass density of sea water, (4) can be substituted into (3) to give the expression for maximum thrust at incipient cavitation breakdown (sometimes called "super cavitation").

Since from (4):

$$V_e^2 = T/(\rho A_e) \quad (5)$$

then at the incipient cavitation breakdown condition:

$$T_c = (33+d)2Sg\rho(A_p^2/A_e) \quad (6)$$

Thus, Equation (6) shows that the thrust limit set by cavitation increases as $A_e$ decreases.

As explained above, the constrictors of the screen reduce the exit jet cross-sectional area ($A_e$), and therefore, increase the thrust limit set by cavitation. The screens can be applied to general purpose propulsion systems such as those found in tugboats where presently large propeller blades provide low efficiencies due to their large wetted areas subject to hydrodynamic skin drag. Large screens would be made preferably from cast stainless steel with round bar elements 31 and with the streamlined fairings 32, as in FIG. 8. The screens when made in large scale can also be applied to large ship transverse thrusters with similar advantages as those discussed herein. Further, due to the strength and stiffness of the screens of this design, at least one or both of them can be used to support the propeller and its drive motor. This eliminates struts normally required.

Thus, a screen system has been described. While embodiments, applications, and advantages of the invention have been shown and described, many more embodiments and advantages are possible without deviating from the inventive concepts described herein. Thus, the invention is not to be restricted except in accordance with the spirit of the appended claims.

What is claimed:

1. A thruster screen system comprising:

a first screen, said first screen comprising a grating, said grating comprising a plurality of apertures;

a second screen, said second screen comprising a grating, said grating comprising a plurality of apertures;

a housing having a first open end and a second open end, said housing defining a chamber between said first and second open ends; said first screen mounted at said first open end, said second screen mounted at said second open end;

at least one constrictor at said first screen, said at least one constrictor being associated with one of said plurality of apertures at said first screen;

at least one constrictor at said second screen, said at least one constrictor being associated with one of said plurality of apertures at said second screen;

wherein said at least one constrictor at said first screen opens and closes automatically according to a fluid flow characteristic through said one of said plurality of apertures of said first screen, and wherein said at least one constrictor at said second screen opens and closes automatically according to a fluid flow characteristic through said one of said plurality of apertures of said second screen;

wherein said at least one constrictor at said first screen comprises:

a center plate, said center plate having a longitudinal axis, and is secured across said one of said plurality of apertures near a center of said one of said plurality of apertures of said first screen so that said longitudinal axis of said center plate is substantially parallel to a longitudinal axis of said one of said plurality of apertures of said first screen;

a first plate, said first plate connected at one end to said center plate at said first screen; and a second plate, said second plate connected at one end to said center plate at said first screen, said first and second plates capable of closing and opening said one of said plurality of apertures at said first screen;

and wherein said at least one constrictor at said second screen comprises:

a center plate, said center plate having a longitudinal axis, and is secured across said one of said plurality of apertures near a center of said one of said plurality of apertures of said second screen so that said longitudinal axis of said center plate is substantially parallel to a longitudinal axis of said one of said plurality of apertures of said second screen;

a first plate, said first plate connected at one end to said center plate at said second screen; and a second plate, said second plate attached at one end to said center plate at said second screen, said first and second plates capable of closing and opening said one of said plurality of apertures at said second screen.

2. A thruster screen system comprising:

a first screen, said first screen comprising a grating, said grating comprising a plurality of apertures;

a second screen, said second screen comprising a grating, said grating comprising a plurality of apertures;

a housing having a first open end and a second open end, said housing defining a chamber between said first and second open ends; said first screen mounted at said first open end, said second screen mounted at said second open end;

at least one constrictor at said first screen, said at least one constrictor being associated with one of said plurality of apertures at said first screen;

at least one constrictor at said second screen, said at least one constrictor being associated with one of said plurality of apertures at said second screen; and wherein said housing has a top and a bottom surface, said bottom surface formed by a bottom sheet, said top surface defined by a side of a vehicle.

3. A screen system comprising:

a screen, said screen comprising a grating, said grating comprising a plurality of apertures; and at least one constrictor, said at least one constrictor being associated with one of said plurality of apertures, wherein said screen further comprises an opening near its center for supporting a shaft of a propeller.

4. A thruster screen system comprising:

a first screen, said first screen comprising a grating, said grating comprising a plurality of apertures;

a second screen, said second screen comprising a grating, said grating comprising a plurality of apertures;

a housing having a first open end and a second open end, said housing defining a chamber between said first and second open ends; said first screen mounted at said first open end, said second screen mounted at said second open end;

at least one constrictor at said first screen, said at least one constrictor being associated with one of said plurality of apertures at said first screen;

at least one constrictor at said second screen, said at least one constrictor being associated with one of said plurality of apertures at said second screen; and a thruster, said thruster is positioned between said first and second screens, and is supported at a center of said first screen and a center of said second screen.

5. A thruster screen system comprising:

a first screen, said first screen comprising a grating, said grating comprising a plurality of apertures;

a second screen, said second screen comprising a grating, said grating comprising a plurality of apertures;

a housing having a first open end and a second open end, said housing defining a chamber between said first and second open ends; said first screen mounted at said first open end, said second screen mounted at said second open end;

at least one constrictor at said first screen, said at least one constrictor being associated with one of said plurality of apertures at said first screen;

at least one constrictor at said second screen, said at least one constrictor being associated with one of said plurality of apertures at said second screen; and a thruster, said thruster comprises a propeller and a shaft at a center of said propeller, said shaft having a first end supported at a center of said first screen and having a second end supported at a center of said second screen so as to straddle-mount said thruster to the centers of said first and second screens.

* * * * *